US007112039B2

(12) United States Patent
Brooks

(10) Patent No.: US 7,112,039 B2
(45) Date of Patent: Sep. 26, 2006

(54) VARIABLE VANE ELECTRO-GRAPHIC THRUST WASHER

(75) Inventor: Robert T. Brooks, Killingworth, CT (US)

(73) Assignee: United Technologies Corporation, Hartford, CT (US)

( * ) Notice: Subject to any disclaimer, the term of this patent is extended or adjusted under 35 U.S.C. 154(b) by 477 days.

(21) Appl. No.: 10/696,068

(22) Filed: Oct. 29, 2003

(65) Prior Publication Data

US 2005/0091849 A1 May 5, 2005

(51) Int. Cl.
*F03B 3/18* (2006.01)
*F04D 29/56* (2006.01)

(52) U.S. Cl. ..... 415/156; 415/160; 415/162

(58) Field of Classification Search ..... 415/156, 415/155, 160, 162, 163; 416/160, 162, 163, 416/164

See application file for complete search history.

(56) References Cited

U.S. PATENT DOCUMENTS 4,834,613 A * 5/1989 Hansen et al. ..... 415/160
5,039,277 A * 8/1991 Naudet ..... 415/150

* cited by examiner

*Primary Examiner*—Edward K. Look
*Assistant Examiner*—Dwayne J White
(74) *Attorney, Agent, or Firm*—Bachman & LaPointe, P.C.

(57) ABSTRACT

A method for improving the wear characteristics of a system for operating a variable vane comprising the steps of providing a trunnion connected to the variable vane via an vane platform and means for causing rotation of the trunnion, and positioning a thrust washer formed from a carbon material about a lower portion of the trunnion and in a space between the vane platform and an outer split case so that during operation of the system the space between the vane platform and the outer split case is maintained substantially constant and unwanted deflection of the vane is avoided.

14 Claims, 1 Drawing Sheet

VARIABLE VANE ELECTRO-GRAPHIC THRUST WASHER

BACKGROUND OF THE INVENTION (1) Field of the Invention

The present invention relates to a system for operating a variable vane in a gas turbine engine having improved wear characteristics and more particularly to a thrust washer constructed of electro-graphitic carbon for reducing wear used in said system.

(2) Description of the Related Art

In gas turbine engines, the variable vanes of the high pressure compressor are rotated via a trunnion assembly. With reference to FIG. 1, there is illustrated the construction of a portion of an engine including a trunnion 15. The trunnion 15 is situated between a liner housing 41 and an outer split case 22 and extends to a platform 21 through a thrust washer 23. Variable vane 17 is attached to the trunnion 15 via a vane platform 21.

In the past, the thrust washer 23 has been typically constructed of a wear resistant and low friction material such as graphite filled polyimide materials capable of continuous operation up to 650° F. The thrust washers 23 constructed of such polyimide materials are not capable of withstanding the high temperatures and loads of advanced high performance compressors. Potentially, this is a problem because it is necessary to avoid metal to metal contact between the vane platform 21 of the variable vane 17 and the outer split case 22. Such metal to metal contact could serve to degrade the vane platform 21 and the outer split case 22 and alter the physical geometry of each and induce higher friction in the variable vane kinematic system. Geometric alterations are undesirable because they can result in an undesirable angular displacement of the variable vane 17. Specifically, if a variable vane 17 is displaced with respect to adjacent vanes by more than 6°, a less than optimal operating scenario may be induced. It is therefore important that the vane platform 21 and the outer split case 22 operate in such a manner as to maintain their shapes, and, thus, maintain a constant variable vane angle.

What is therefore needed is a thrust washer which does not suffer material breakdown at high temperatures and which serves to maintain the fit and orientation of the vane platform 21 and the outer split case 22.

SUMMARY OF THE INVENTION

Accordingly, it is an object of the present invention to provide a system for operating a variable vane in a gas turbine engine having improved wear characteristics and more particularly to a thrust washer constructed of electro-graphitic carbon for reducing wear used in said system.

In accordance with the present invention, a method for improving the wear characteristics of a system for operating a variable vane comprises the steps of providing a trunnion connected to the variable vane via a vane platform and means for causing rotation of the trunnion, and positioning a thrust washer formed from a carbon material about a lower portion of the trunnion and in a space between the vane platform and an outer split case so that during operation of the system the space between the vane platform and the outer split case is maintained substantially constant and unwanted deflection of the vane is avoided.

In further accordance with the present invention, a system for operating a variable vane in a gas turbine engine comprises a vane, a trunion attached to the vane for rotating the vane, and means for avoiding unwanted deflection of the vane at operating temperatures, the deflection avoiding means comprises a self lubricating thrust washer surrounding a lower portion of the trunnion.

DETAILED DESCRIPTION

It is a teaching of the present invention to provide a variable vane operating system having a thrust washer 23 composed of a carbon based substance, preferably electro-graphitic carbon. It has been suprisingly found that the use of such a thrust washer in a variable vane operating system is advantageous in a high temperature environment because the washer does not suffer significant breakdown even at temperatures approximating 1050° F. In addition, a thrust washer formed from such a material both self lubricates as well as maintains the appropriate distance between the vane platform 21 and the outer split case 22. As used herein, "self lubricate" refers to the ability of the thrust washer of the present invention to degrade through a process of depositing the electro-graphitic carbon from which it is constructed onto the engine components with which it is in contact. As a result of this deposition, the volume originally occupied by the thrust washer remains filled with electro-graphitic carbon of the same volume throughout operation, thus maintaining the original geometry and orientation of the vane platform and outer split case. The thrust washer of the present invention may operate for extended periods of time at high temperatures while maintaining its geometry so as to avoid unwanted deflection of the variable vane.

Figure 1:
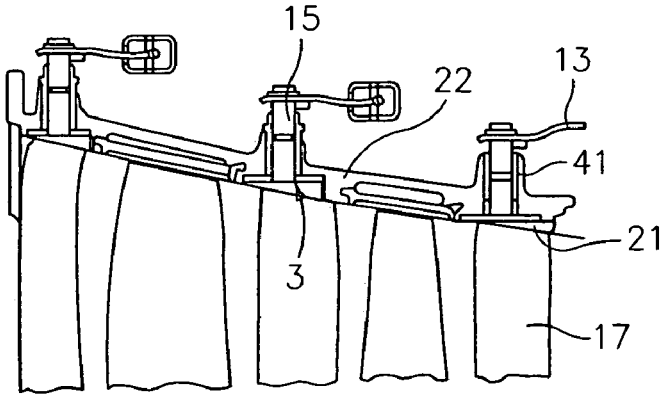
FIG. 1 A diagram of a gas turbine engine having a variable vane operating system.
Figure 2:
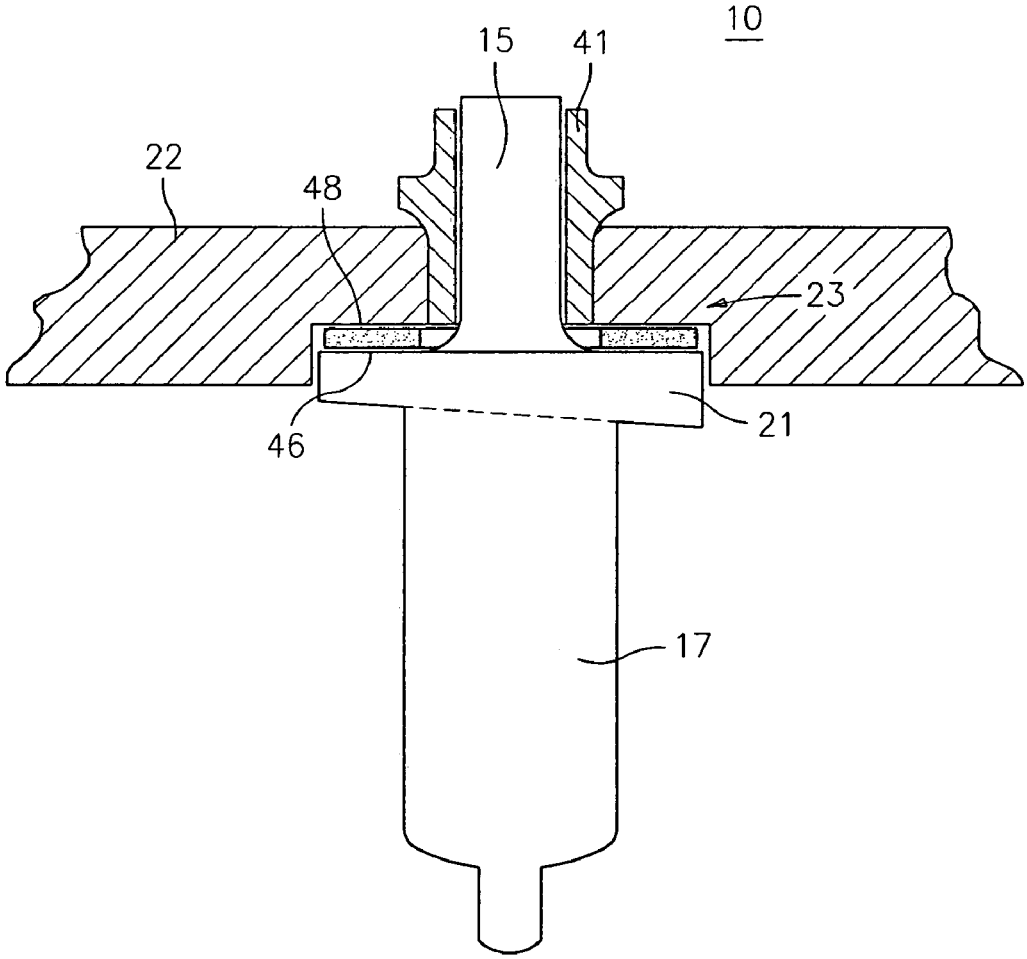
FIG. 2 An enlarged view of a variable vane operating system in accordance with the present invention.

With reference to FIG. 2, there is illustrated a system 10 for operating a variable vane 17 used in a gas turbine engine. The system 10 includes a trunnion 15 and a drive system 13 for causing rotation of the trunnion 15. As shown in FIG. 2, the trunnion 15 is connected to the vane 17 via the vane platform 21 and imparts rotation to the vane 17 via the vane platform 21. The trunnion 15 is positioned between the split case 22 and the liner housing 41, a thrust washer 23 is positioned adjacent a lower end of the trunnion 15 and is used to prevent contact between the vane platform 21 and the outer split case 22. The thrust washer 23 is generally disc shaped and has a hole through which the trunnion 15 passes. The thrust washer 23, as discussed hereinbefore, is composed of a carbon material which is capable of withstanding a high temperature environment up to 1050° F. and which is self lubricating. Preferably, the thrust washer 23 is formed from an electro-graphitic carbon material. The thrust washer 23 of the present invention prevent wears of the vane platform 21 and the outer split case 22 and maintains the orientation of the trunnion 15 and thus the vane 17. In operation, the drive system 13, which may be any suitable drive system known in the art, causes rotation of the trunnion 15 and a resulting rotation of the vane platform 21 and the vane 17. As the vane platform 21 rotates, it moves with respect to the outer split case 22. Operation of the system 10 in a high temperature environment of at least about 850° F., and preferably up to 1050° F. or higher, causes the material forming the thrust washer 23 to adhere to and fill voids created in the adjacent surfaces of the vane platform 21 and the outer split case 22. Over time, as the thrust washer degrades, the material from which the thrust washer 23 is formed continues to occupy the space between the vane platform surface 46 and the outer split case surface 48. It can be said that because of this, the thrust washer 23 becomes self lubricating, due to the lubricating nature of the graphitic-carbon material and acts to provide a very stable lubricious graphite-to-graphite contact surface. In addition, as the graphite distributes itself about the vane platform 21 and the outer split case 22, the total volume of the graphite remains unchanged. As a result, there is maintained a constant spacing between the vane platform 21 and the outer split case 22 equal to the original thickness of the thrust washer 23. The geometry of the vane platform 21 with respect to the outer split case 22 remains constant and therefore avoids any unwanted deflection of the variable vane 17.

Tests conducted at 850° F. confirm that a thrust washer 23 formed from an electro-graphitic carbon material in accordance with the present invention exhibits a 3.5X wear resistance over the washers known in the art over a sixty-five hour period and continued to run up to 207 hours with the same amount of wear as a polyimide designed washer experienced at sixty-five hours.

During installation of the thrust washers of the present invention, some geometric adjustments to the inner and outer diameters may have to be made to accommodate thermal expansion rate. This is because carbon materials such as electro-graphitic carbon have a lower thermal expansion rate than polyimide materials. In addition, chamfers and/or blending of edges may be required to minimize pinch points at the fillet radius of the vane trunnion. Without these adjustments, pre-mature spallations/cracking could occur from the edges.

It is apparent that there has been provided in accordance with the present invention an improved operating system for a variable vane which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A method for improving the wear characteristics of a system for operating a variable vane comprising the steps of:

providing a trunnion connected to said variable vane via a vane platform and means for causing rotation of said trunnion; and positioning a thrust washer formed from a carbon material comprising electrographitic carbon about a lower portion of said trunnion and in a space between said vane platform and an outer split case so that during operation of said system said space between said vane platform and said outer split case is maintained substantially constant and unwanted deflection of said vane is avoided.

2. The method of claim 1 further comprising maintaining a generally constant geometry between said vane platform and said outer split case by allowing said thrust washer to degrade so as to lubricate surfaces of said vane platform and said outer split case with graphite.

3. The method of claim 2 further comprising the additional step of operating said system at a temperature of at least 850° F.

4. The method of claim 3 further comprising the additional step of operating said system at a temperature greater than 1050° F.

5. A system for operating a variable vane in a gas turbine engine comprising:

a vane;

a trunion attached to said vane for rotating said vane; and means for avoiding unwanted deflection of said vane at operating temperatures, said deflection avoiding means comprises a self lubricating thrust washer comprising electrographitic carbon surrounding a lower portion of said trunnion.

6. A system according to claim 5 further comprising:

said trunnion being connected to said vane via a vane platform;

a split case spaced from said vane platform; and said thrust washer being positioned between a space between said vane platform and said split case.

7. A system according to claim 6 wherein said thrust washer decomposes at operating temperatures so as to self lubricate surfaces of said split case and said vane platform.

8. A system according to claim 6 wherein said thrust washer decomposes at operating temperatures so as to fill in surface voids in surfaces of said split case and said vane platform.

9. A system according to claim 6, wherein said thrust washer decomposes at operating temperatures so as to maintain the space between said split case and said vane platform and thereby avoid said unwanted deflection of said vane.

10. A system according to claim 6, wherein the thrust washer is capable of operation at a temperature of at least 850° F.

11. A system according to claim 6, wherein the thrust washer is capable of operation at a temperature of at least 1050° F.

12. A system according to claim 5, wherein the thrust washer is capable of operation at a temperature of at least 850° F.

13. A system according to claim 5, wherein the thrust washer is capable of operation at a temperature of at least 1050° F.

14. A system according to claim 5, wherein the thrust washer self-lubricates at an operational temperature of at least 1050° F. by transferring graphite to surfaces of said vane and an outer split case to provide graphite to graphite engagement.

* * * * *